United States Patent [19]

Inglis

[11] Patent Number: 4,896,747

[45] Date of Patent: Jan. 30, 1990

[54] MODULAR ELEVATOR SYSTEM

[75] Inventor: John Inglis, Killara, Australia

[73] Assignee: Otis Elevator Company, Farmington, Conn.

[21] Appl. No.: 225,501

[22] Filed: Jul. 28, 1988

[51] Int. Cl.[4] ..... B66B 9/00

[52] U.S. Cl. ..... 187/1 R; 187/35; 187/130

[58] Field of Search ..... 187/1 R, 32, 35, 100, 187/130; 52/79.1, 127.1

[56] References Cited

U.S. PATENT DOCUMENTS

| | | | |
|---|---|---|---|
| 2,647,287 | 8/1953 | Jones | 52/127 X |
| 3,631,942 | 1/1972 | Brounn | 187/1 R |
| 3,749,203 | 7/1973 | Hoelscher | 187/32 X |
| 4,311,212 | 1/1982 | Simpson | 187/130 X |
| 4,361,208 | 11/1982 | Jackson et al. | 187/1 R |
| 4,443,992 | 4/1984 | Shechter | 52/79.1 X |
| 4,470,227 | 9/1984 | Bigelow, Jr. et al. | 52/79.1 |
| 4,700,809 | 10/1987 | Lazar | 187/1 R |
| 4,779,707 | 10/1988 | Smith et al. | 187/1 R |

FOREIGN PATENT DOCUMENTS

| | | | |
|---|---|---|---|
| 0055142 | 5/1977 | Japan | 187/32 |
| 0033451 | 3/1979 | Japan | 187/1 R |
| 0040455 | 3/1979 | Japan | 187/1 R |
| 1313797 | 5/1987 | U.S.S.R. | 187/1 R |
| 2104041A | 3/1983 | United Kingdom | 187/1 R |
| 2139183A | 11/1984 | United Kingdom | 187/1 R |

*Primary Examiner*—Joseph J. Rolla

*Attorney, Agent, or Firm*—William W. Jones

[57] ABSTRACT

A modular elevator system is disclosed incorporating a wiring and control module which is attached to the elevator car. One of the modules includes a floor selection device and display panel accessible from within the elevator car and a proximity sensor accessible from the outside of the elevator car. The other modules are attached to the elevator shaft and disposed at aligned and vertically spaced locations corresponding to each floor. The modules interact to control door operation and elevator car position.

3 Claims, 7 Drawing Sheets

MODULAR ELEVATOR SYSTEM

TECHNICAL FIELD

This invention relates to elevators.

BACKGROUND ART

It has been common practice in the past to pre-assemble elevator cars in the factory, then dismantle the completed cars and re-assemble them in situ. This necessarily involves much double handling and lost time, particularly with separately wired-in units such as the control panel, the indicator lamp assembly and the various proximity switches and controls, all of which have been located at different positions around the car.

Similarly, the corresponding fixed sensors and switches have been mounted in different positions around the elevator shaft and require individual positioning and assembly on site.

The structural components of the car have also been designed so they can be specially assembled to meet particular requirements for door, wall, window or specialized accessory positioning. These may be specified in many different front and back or left and right hand configurations.

DISCLOSURE OF THE INVENTION

It is an object of the invention to provide an improved elevator system which will greatly simplify the construction and installation process.

According to the invention there is provided a modular elevator system incorporating a wiring and control mounting module for attachment in a preselected location on the car, said car module including both floor selection and display means accessible from within said car and further including proximity sensing means accessible from outside said car and able operatively to interact with complimentary sensing means on complimentary shaft modules attached to the elevator shaft at aligned and vertically spaced locations corresponding to each floor.

Preferably, both the car and shaft modules are removably attachable to their respective locations.

Preferably also, the car includes a central structural module including a preselected position for removably accepting the car control module and also including oppositely directed mounting ports symmetrically disposed about this preselected position for receiving and supporting preselected door, window, wall or accessory units each correspondingly dimensioned for selective and interchangeable engagement with either of said ports.

BEST MODE FOR CARRYING OUT THE INVENTION

Figure 1:
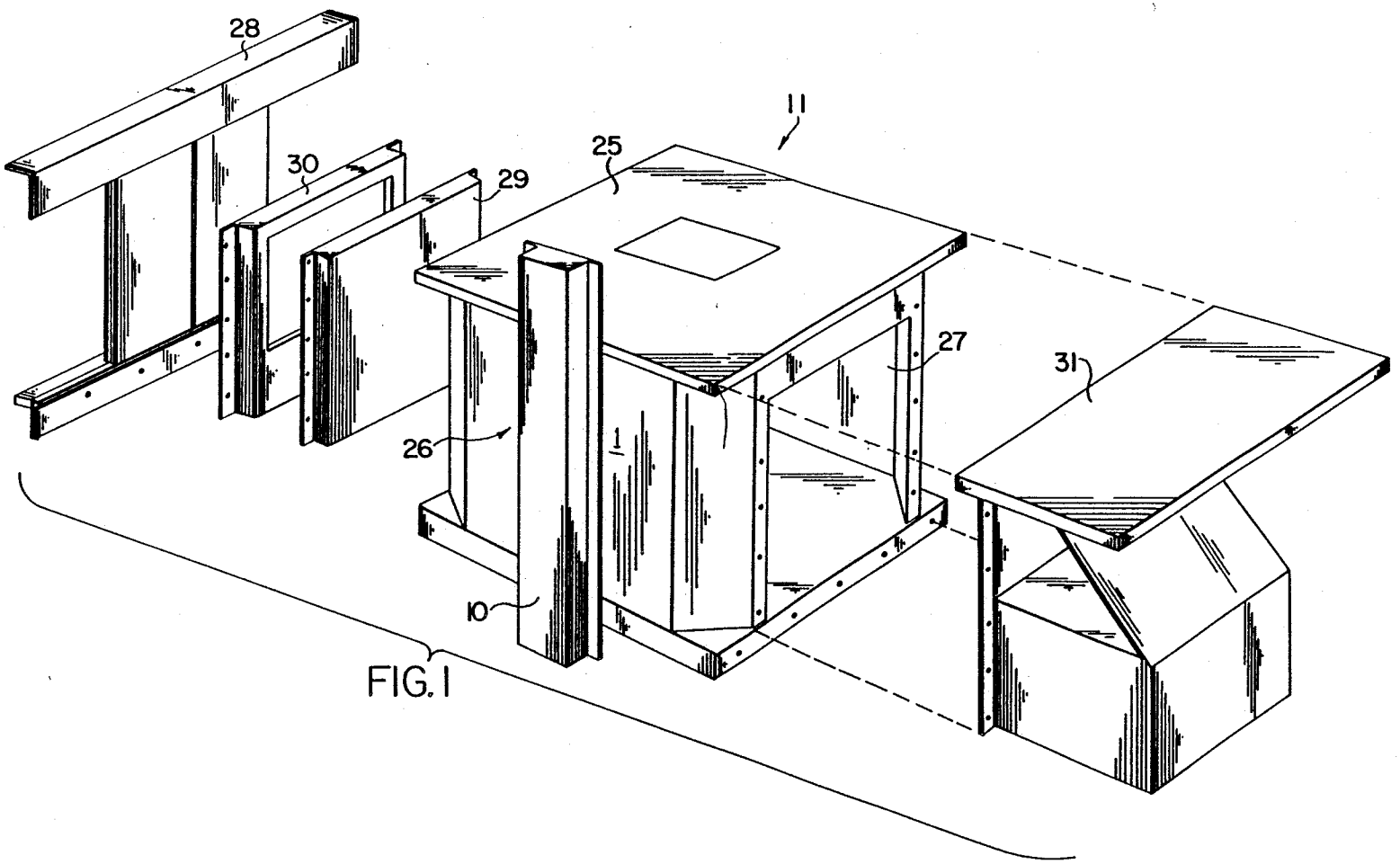
FIG. 1 is a schematic exploded perspective view of a modular elevator car and interchangeable components.
Figure 2:
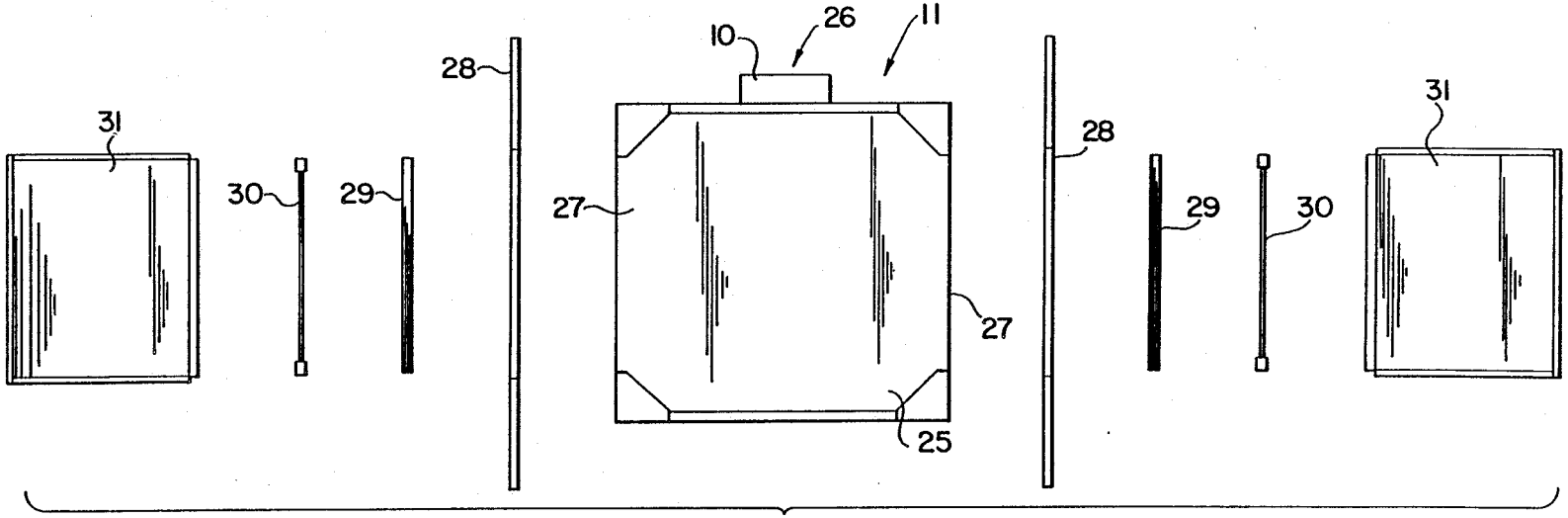
FIG. 2 is a schematic plan view of the components illustrated in FIG. 1.
Figure 3:
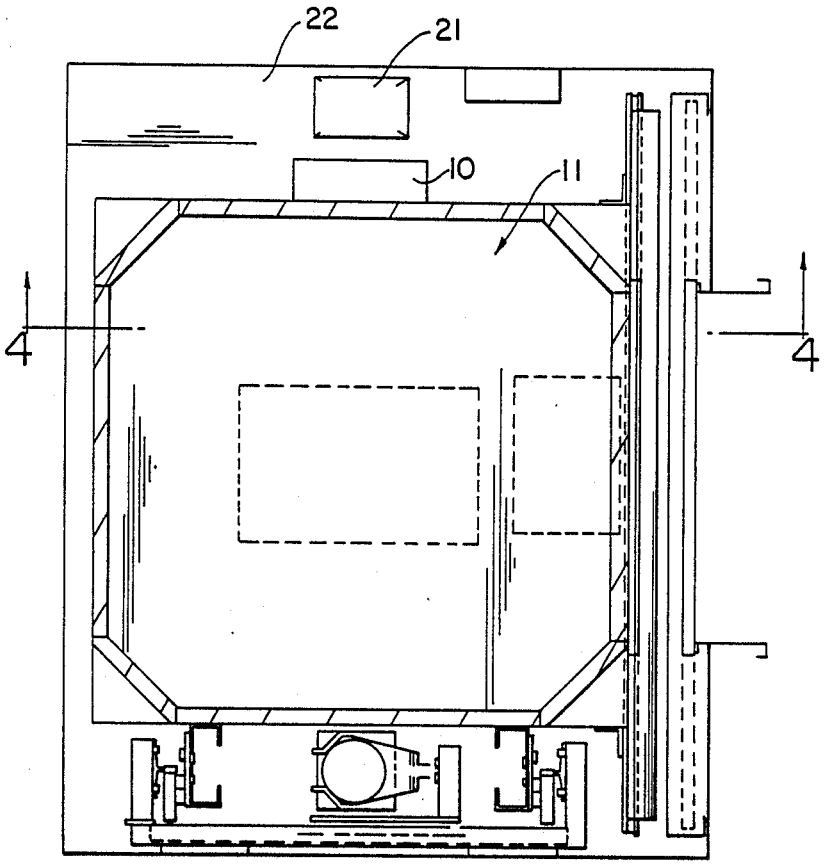
FIG. 3 is a sectional plan view of an elevator car illustrating the position of the car and shaft modules.
Figure 4:
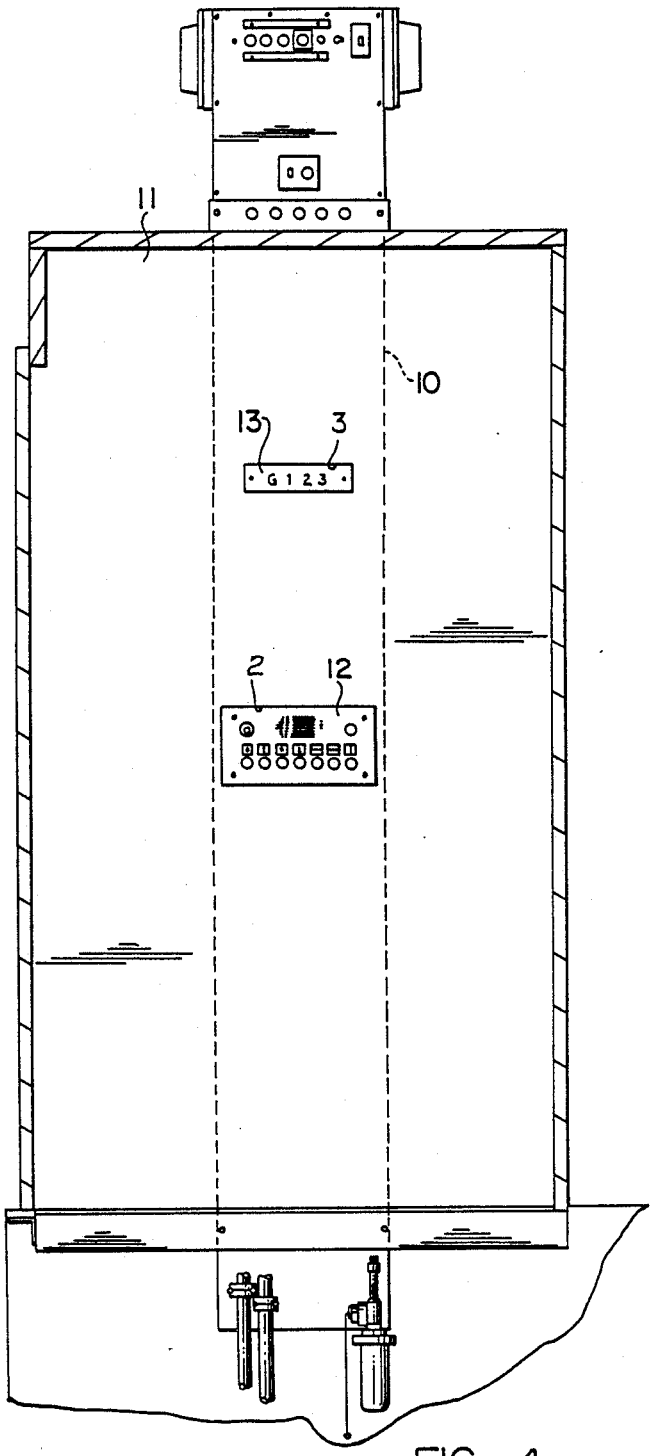
FIG. 4 is a side elevation taken on line 4—4 of FIG. 3 illustrating the car module.
Figure 5:
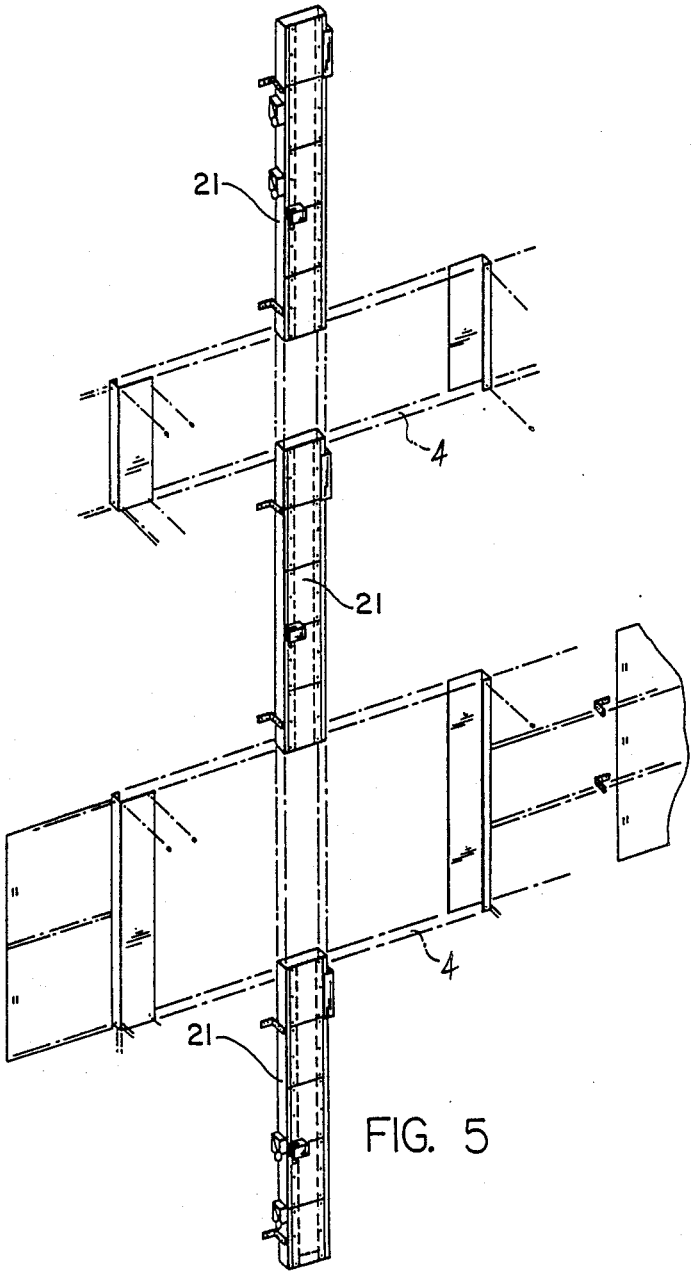
FIG. 5 is a schematic perspective view showing three shaft modules located in aligned and vertically spaced locations corresponding to three floors.
Figure 6:
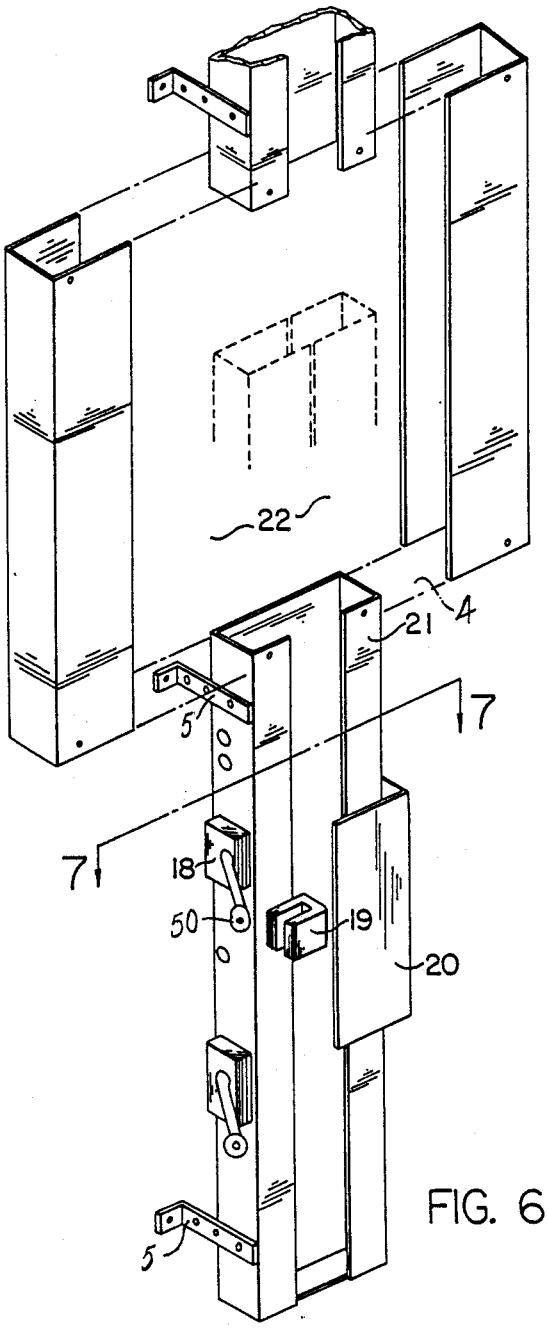
FIG. 6 is an enlarged perspective view of one of the shaft modules shown in FIG. 5.
Figure 7:
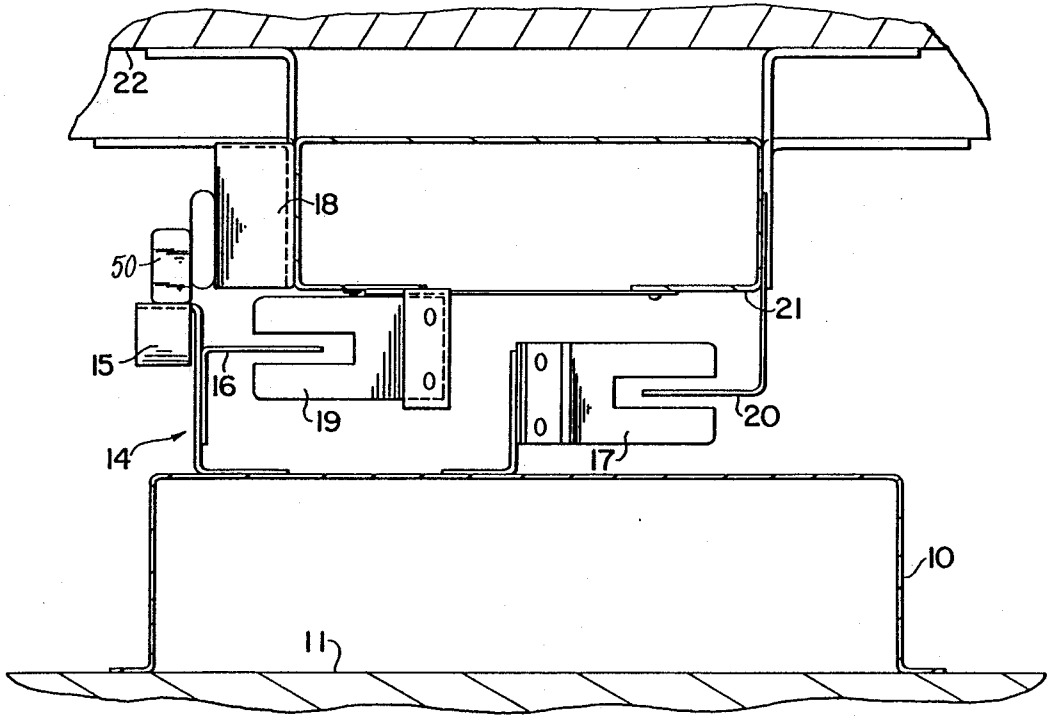
FIG. 7 is a sectional plan view taken in direction 7—7 of FIG. 6 and illustrating the interengagement of a shaft module with the car module.

Referring to the drawings, the modular elevator system includes a wiring and control mounting module 10 for attachment in a preselected location 26 on the outside of a wall 1 on the central structural module 25 of the car 11 as shown. The car control module 10 may be fastened to the car wall 1 by conventional means such as bolts, screws, or the like, and includes both floor selection and control means 12 via openings 2 and 3 respectively in the car wall 1. The control module 10 floor display means 13 accessible from with the car and further includes proximity sensing means 14 accessible from outside the car. The proximity sensing means 14 include such components as tripping units 15 which engage rollers 50 on shaft module limit switches 18 to control movement of the car 11, as shown in FIG. 7; trip vanes 16 which cooperate with shaft module magnetic switches 19 to sense the position of the car 11 relative to a floor landing 4; and magnetic switches 17 which cooperate with shaft module vanes 20 to sense the position of the car 11 relative to the floor landings 4. The shaft modules 21 are attached to the elevator shaft 22 with straps 5 at aligned and vertically spaced locations corresponding to each floor, as best shown in FIG. 6 so as to be able to cooperate with the car control module components noted above whereby the position of the car is properly monitored, and movement of the car is controlled, as is door operation. Thus the shaft module magnetic switches 19 and vanes 20 interact with the car module vanes 16 and magnetic switches 17 respectively in response to car position in the shaft. The switches 17 and 19 control car leveling and door operation in a conventional fashion.

The car and shaft modules are individually assembled in the factory. The bulk of this work need be done only once since the pre-assembled car modules can be removably fitted to the car during a preliminary assembly or fitted permanently to the car on site. Both the car and shaft modules are preferably removably attachable to their respective locations at any time, even following final installation.

Preferably also, the car 11 includes a central structural module 25 including a preselected position 26 for removably accepting the car control module 10 and also including oppositely directed mounting ports 27 symmetrically disposed about this preselected position for receiving and supporting, by means of bolts, screws, or the like, preselected door 28, wall 29, window 30, or boot extension and roof extension units 31 for enlarging the car and roof capacity, each correspondingly dimensioned for selective and interchangeable engagement with either of the ports. This greatly reduces the complexity associated with providing a range of alternative combinations.

Although the invention has been described with reference to a specific example, it will be appreciated by those skilled in the art that the invention may be embodied in many other forms.

I claim:

1. An elevator system for mounting in an elevator shaft having a pluraltiy of door landings therein, said system comprising:

(a) a car module having a pair of opposed permanent walls and a pair of opposed intervening mounting ports extending between corresponding ends of said permanent walls;

(b) a modular door assembly removably affixed to and closing one of said mounting ports;

(c) a modular wall assembly removably affixed to and closing the other of said mounting ports;

(d) a car control module mounted on an outside surface of one of said car module permanent walls, said car control module carrying car wiring, and also carrying floor selection and control means as well as floor display means, said floor selection, control and display means being visible and accessible from the interior of said car module via openings in said one car module permanent wall;

(e) shaft modules for mounting in an elevator shaft proximate to each landing therein, said shaft modules comprising tripping switch means, magnetic switch means, and magnetic switch vane means carried on mounting means adapted to be secured in place in the elevator shaft; and (f) proximity sensing means mounted on said car control module externally of said car module, said proximity sensing means including: tripping means for cooperating with said shaft module tripping switch means for decelerating the car module in the shaft; magnetic switch means for cooperating with said shaft module magnetic switch vane means for sensing car module position and controlling car door operation; and magnetic switch vane means for cooperating with said shaft module magnetic switch means for sensing car module position and car leveling.

2. The elevator system of claim 1 wherein said modular wall assembly is a window wall assembly.

3. The elevator system of claim 1 wherein said modular wall assembly is configured to expand usable interior space of said car module.

* * * * *

UNITED STATES PATENT AND TRADEMARK OFFICE

CERTIFICATE OF CORRECTION

PATENT NO. : 4,896,747

DATED : January 30, 1990

INVENTOR(S) : John Inglis

It is certified that error appears in the above-identified patent and that said Letters Patent is hereby corrected as shown below:

In Col. 2, lines 14-18 after "12" delete "via openings 2 and 3 respectively in the car wall 1. The control module 10 floor display means 13 accessible from with the car and further includes proximity sensing means 14 accessible from outside the car." and insert --and floor display means 13 accessible from within the car via openings 2 and 3 respectively in the car wall 1. The control module 10 further includes proximity sensing means 14 accessible from outside the car.--

Signed and Sealed this

Second Day of March, 1993

*Attest:*

STEPHEN G. KUNIN

*Attesting Officer*

*Acting Commissioner of Patents and Trademarks*